US005384916A

United States Patent [19]

Portney

[11] Patent Number: 5,384,916

[45] Date of Patent: Jan. 31, 1995

[54] SIZE ADJUSTABLE CAP

[75] Inventor: Alvin Portney, St. Louis, Mo.

[73] Assignee: Western Textile Products Company, St. Louis, Mo.

[21] Appl. No.: 139,416

[22] Filed: Oct. 20, 1993

Related U.S. Application Data

[63] Continuation-in-part of Ser. No. 57,481, May 3, 1993, abandoned.

[51] Int. Cl.[6] ..... A42B 1/22

[52] U.S. Cl. ..... 2/195.2; 2/418

[58] Field of Search ..... 2/171, 171.4, 171.5, 2/171.7, 171.8, 175.1, 181, 181.2, 181.4, 183, 195.1, 195.2, 195.3, 195.4, 417, 418, 420, 909, 918, DIG. 11

[56] References Cited

U.S. PATENT DOCUMENTS

| | | | |
|---|---|---|---|
| 1,725,425 | 8/1929 | Steingold . | |
| 1,894,213 | 1/1933 | Ostolaza | 2/183 |
| 2,869,137 | 1/1959 | Scherz | 2/197 |
| 4,011,600 | 3/1977 | Malk | 2/183 |
| 4,061,898 | 12/1977 | Murray et al. | 219/211 |
| 4,173,042 | 11/1979 | Krzewinski-Morris | 2/197 |
| 4,274,157 | 6/1981 | Boden | 2/181 |
| 4,304,005 | 12/1981 | Danley, Sr. | 2/10 |
| 4,481,681 | 11/1984 | Hankin | 2/197 |
| 4,547,903 | 10/1985 | Brown et al. | 2/12 |
| 4,642,817 | 2/1987 | Ferstenfeld | 2/183 |
| 4,776,043 | 10/1988 | Coleman | 2/199 |
| 4,815,148 | 3/1989 | Satterfield | 2/197 |
| 4,845,782 | 7/1989 | Gregg | 2/172 |
| 4,872,218 | 10/1989 | Holt | 2/171 |
| 5,003,640 | 4/1991 | Pizzacar | 2/199 |
| 5,062,163 | 11/1991 | Avey | 2/424 |
| 5,099,524 | 3/1992 | Linday | 2/181 |
| 5,119,514 | 6/1992 | Woehl | 2/195 |
| 5,142,705 | 9/1992 | Edwards | 2/418 |
| 5,161,259 | 11/1992 | Shorts | 2/199 |

FOREIGN PATENT DOCUMENTS 404637 1/1934 United Kingdom .

OTHER PUBLICATIONS

Cherokee Cap Company advertising sheet bearing no date and referring to "Logo Strap" alleged to be (Patent Pending).

*Primary Examiner*—Clifford D. Crowder
*Assistant Examiner*—Diana L. Biefeld
*Attorney, Agent, or Firm*—Polster, Lieder, Woodruff & Lucchesi

[57] ABSTRACT

A size adjustable cap utilizing a new and improved size adjustment strap is disclosed. The size adjustable cap has an opening in the back of the cap between the cap and the size adjustment strap which extends across the opening. The size adjustment strap has one end secured to the cap in the vicinity of a sweatband that is internally attached to the cap proximate its lower margin. The size adjustment strap has a free end and extends through a complementary shaped slot provided in the cap in the vicinity of the sweatband on an opposite side of the cap opening to allow the size adjustment strap to pass through the complementary shaped slot for positionment between the sweatband and the cap. Cooperating adjustment fasteners are associated with the size adjustment strap and the sweatband for engagement with one another when the size adjustment strap is positioned between the sweatband and the cap. Preferably, the cooperating adjustable fasteners are loop and hook fasteners. The loop fasteners are associated with the size adjustment strap and the hook fasteners are associated with the sweatband. The size adjustment strap includes a strip of fabric material for covering the loop fasteners and for facing outwardly from a user. The strip of the fabric material may correspond to the same fabric material as the cap, if desired.

4 Claims, 3 Drawing Sheets

SIZE ADJUSTABLE CAP

CROSS REFERENCE TO RELATED APPLICATION

This is a continuation-in-part application of patent application Ser. No. 08/057,481 filed May 3, 1993 entitled SIZE ADJUSTABLE CAP, now abandoned; as well as being a related application to a copending application filed in the name of Bernhard Conrad and bearing Ser. No. 08/144,417 filed Nov. 2, 1993, also entitled SIZE ADJUSTABLE CAP.

BACKGROUND OF THE INVENTION

The present invention relates to a new and improved size adjustment strap in a size adjustable cap.

Several different cap adjustment techniques are employed for accommodating different head sizes of consumers. Caps must either be "sized", that is provided in a number of different cap sizes, or must include a size adjustment mechanism or device. Typically, "sized" caps are the more expensive and high quality caps. This is principally due to the high cost of manufacture and the cost of inventoring caps in a variety of different sizes. Less expensive caps are usually provided with a size adjustment mechanism or device to enable the cap to be adjusted to the head size of the wearer. Such size adjustment mechanism or devices are most usually found on baseball style caps, although they can be used in any cap design.

Where size adjustment mechanisms or devices are used, several different approaches have been employed. One approach includes the use of an elastic band or device that provides a resilient expansion for enlargement or reduction of the inner circumference of the cap to fit the head of the wearer. Another type of size adjustment mechanism or device includes a strap and buckle device which is attached to the cap across an opening in the back of the cap. The strap is held by the buckle in a variety of different positions to enlarge or reduce the internal circumference of the cap for adjusting to the head of the wearer. Another type of size adjustment mechanism or device includes the use of a pair of molded plastic straps which expand or reduce the opening at the rear of the cap. One of the straps has a plurality of holes and the other strap has a plurality of studs for engaging the holes in releasable locking engagement. This well known construction enables the straps to be connected to each other at a number of positions, through the re-positionment of the studs and the holes, in order to adjust the size of the cap. Still another type of size adjustment mechanism or device includes the use of hook and pile or hook and loop fasteners, typically referred to as "VELCRO" fasteners which are used in a variety of different ways. As disclosed herein, the present invention employs, in its preferred embodiment, hook and pile or hook and loop fasteners, together with other elements and components of the cap, in an innovative and unique construction not previously disclosed in the prior art.

Hook and pile or hook and loop type size adjustment mechanisms or devices have included an overlapping circumferential strap or sweatband having the hook and pile or hook and loop fasteners in adjustable mating engagement at opposite free ends of such strap or sweatband, such as shown in U.S. Pat. No. 4,642,817 and 4,845,782. Another type of hook and pile or hook and loop adjustment device is shown in U.S. Pat. No. 4,815,148 in which hook and pile or hook and loop fasteners are mounted on the inside of the sweatband, in order to provide a closed, tuck-in cap look with no gap at the rear of the cap.

The present invention uses hook and pile or hook and loop fasteners in a size adjustable strap that provides several new and important features and advantages. As will also be explained below, the new and improved size adjustment strap of the present invention provides such new features and advantages in a construction that is not available from any of the aforementioned prior art constructions.

SUMMARY OF THE INVENTION

Among the several objects and advantages of the present invention include:

- The provision of a size adjustable cap with a new and improved size adjustment strap that is attached to the cap at one end in the vicinity of a cap sweatband and which also extends across an opening in the back or rear of the cap;
- The provision of the aforementioned new and improved size adjustment strap which is convenient and easy to use, while also having considerable adjustment capability for adjusting the cap to a wide variety of sizes;
- The provision of the aforementioned size adjustment strap which includes the positionment of the size adjustment strap between an internally attached sweatband and the cap, in order to enable cooperating adjustable fastening means associated with the size adjustment strap and the sweatband to engage one another;
- The provision of the aforementioned size adjustment strap which cooperates with a complementary shaped slot formed in the cap in one embodiment;
- The provision of the aforementioned size adjustment strap which cooperates with a complementary shaped slot forming a laterally outerwardly directed opening at one end of the sweatband that receives the free end of the side adjustment strap;
- The provision of the aforementioned size adjustment strap in which the cooperating adjustable fastening means includes loop and hook fasteners associated with the size adjustment strap and sweatband, respectively;
- The provision of the aforementioned size adjustment strap in which loop fasteners associated with the size adjustment strap face the head of a user, when the cooperating adjustable fastening means are in engagement with one another;
- The provision of the aforementioned new and improved size adjustment strap which further includes a strip of fabric material that covers the loop fasteners and also faces outwardly from a user when the cooperating adjustable fastening means are in engagement with one another;
- The provision of the aforementioned new and improved size adjustment strap in which the strip of fabric material that covers the loop fasteners is made of the same fabric material as the cap;
- The provision of the aforementioned new and improved size adjustment strap in which the strip of fabric material covering the loop fasteners can have an advertising medium or logo imprinted or sewn in the fabric material strip; and The provision of the aforementioned new and improved size adjustment strap which is simple, effective, easy to make and use, extremely durable in repeated use, economical and is otherwise well adapted for the purposes intended.

Briefly stated, the size adjustment strap is utilized in a size adjustable cap having an opening in the back of the cap between the cap and the size adjustment strap. The size adjustment strap has one end that is secured to the cap in the vicinity of a sweatband and is internally attached to the cap proximate its lower margin. The size adjustment strap has a free end that extends through a complementary shaped slot provided in the cap in the vicinity of the sweatband on an opposite side of the cap opening to allow the size adjustment strap to pass through the complementary shaped slot for positionment between the sweatband and the cap. Cooperating adjustable fastening means are associated with the size adjustment strap and the sweatband for engagement with one another when the size adjustment strap is positioned between the sweatband and the cap.

The cooperating adjustable fastening means includes loop and hook fasteners associated with the size adjustment strap and the sweatband. The loop fasteners are preferably associated with the size adjustment strap and the hook fasteners preferably associated with a sweatband. When the size adjustment strap extends through the complementary shaped slot in the cap, the loop fasteners of the size adjustment strap face the head of a user.

The size adjustment strap includes a strip of fabric material covering the loop fasteners which faces outwardly from a user when the cooperating adjustable fastening means are in engagement with one another. The fabric material for the size adjustment strap is preferably the same fabric material as the cap. An advertising medium or logo may be printed or sewn in the strip of fabric material for high visibility, if desired.

The complementary shaped slot is generally aligned with both the size adjustment strap and the sweatband, while also extending at a slight angle to a plane that is transverse to the size adjustment strap and the sweatband.

In one embodiment, the complementary shaped slot is formed in the cap; in a second embodiment, the complementary shaped slot is formed by an open end of the sweatband itself, in order to provide a clean and attractive looking size adjustment strap from the rear of the cap.

These and other objects and advantages of the present invention will become apparent from the discussion that follows.

BRIEF DESCRIPTION OF THE DRAWINGS

In the drawings.

FIG. 1 is a rear perspective view of a typical baseball style cap which employs the size adjustment strap of the present invention;

FIG. 2 is also a rear perspective view of the baseball style cap with the size adjustment strap separated from the cap or hat on one end, in order to show a series of loop fasteners on the inside face of the size adjustment strap;

FIG. 3 is a rear view of the baseball style cap shown in FIGS. 1–2, with the size adjustment strap also being separated from the cap on one end, and also depicting hook fasteners associated with a sweatband on the inside of a cap, as shown by the broken away portions of the illustration.

FIG. 4 is another rear view of the baseball style cap and illustrating one of the engaged positions of the size adjustment strap, through the broken away portions of the cap;

FIG. 5 is still another rear view of the baseball style cap and illustrating another engaged position of the size adjustment strap, for adjusting a cap to the head of a user; and FIG. 6 is a substantially enlarged fragmentary sectional view of the baseball style cap specifically illustrating the cooperating adjustable fastening hook and loop elements of the size adjustment strap, as viewed along lines 6—6 of FIG. 5.

FIG. 7 is a rear view of the baseball style cap which illustrates a modified complementary shaped slot formed in one end of the cap sweatband for receiving the size adjustment strap;

FIG. 8 is an enlarged fragmentary inside view of the baseball style cap illustrated in FIG. 7 which depicts the manner in which one end of the sweatband is formed to provide the modified complementary shaped slot; and FIG. 9 is an enlarged fragmentary sectional view illustrating the cooperative interengagement of the hoop and loop fasteners associated with the size adjustment strap and sweatband in the FIGS. 7–9 embodiment.

Corresponding reference numerals will be used throughout the several figures of the drawings.

DESCRIPTION OF THE PREFERRED EMBODIMENT

Figure 1:
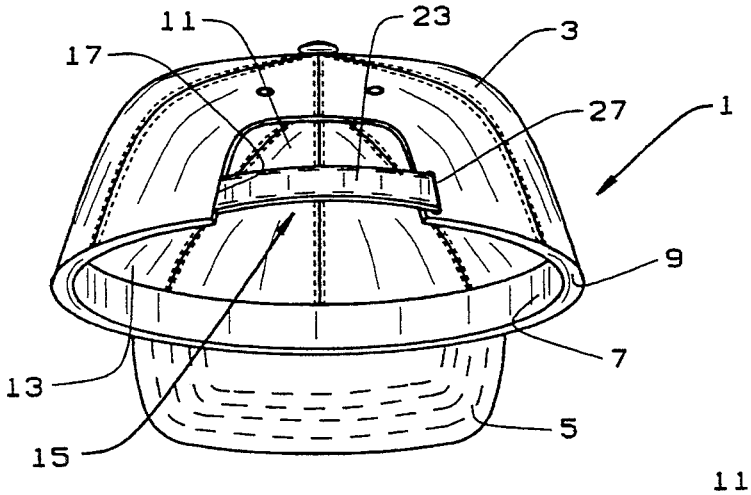
FIGS. 1–6 show one embodiment of the size adjustment strap of the present invention.

The following detailed description illustrates the invention by way of example and not by way of limitation. This description will clearly enable one skilled in the art to make and use of the invention, and describes several embodiments, adaptions, variations, alternatives and uses of the invention, including what I presently believe is the best mode of carrying out the invention.

The term "cap" as used in the following description is intended to refer to any type or kind of cap or hat, with or without a brim or visor, which may be used for a variety of different purposes, as may be desired.

The hat or cap shown in FIGS. 1–9 of the drawings is of the baseball cap variety since the present invention is particularly adapted for such hat or cap styles. However, it is to be understood that the present invention can be employed in any type or style of hat or cap, as may be desired.

Reference is first made to the first embodiment of the present invention shown in FIGS. 1–6.

The baseball style cap 1 includes a crown 3 in a modified or tapered hollow semi-spherical shape which is constructed from a number of fabric panels that are interconnected by sewing, as is well known. A crescent-shaped visor 5 is attached to the crown 3 at the front of the cap 1.

A sweatband 7 extends around the inner periphery of the cap crown 3 and is attached to the crown 3 proximate its lower margin 9. In some instances, the visor 5 is not only attached to the crown 3, but may also be sewn, in part, to the sweatband 7, at the front of the hat.

At the rear or back of the cap 1 is an opening 11 which changes to different shaped openings, to adjust the size of the cap opening 13, to the head size of the user.

According to the present invention, the size adjustment strap 15 includes an elongated strap 17 having one end 19 secured to the cap adjacent the lower margin 9 of the crown in the vicinity of the sweatband 7. The elongated strip 17 is preferably a two part component including a strip of loop fasteners 21 on one side of the strap 17 and a strip of fabric material 23 on the other side of the strip 17 which is sewn by stitching such as illustrated in the drawings or otherwise attached to the loop fastener strip 21.

As will be understood, the loop fastener strip 21 cooperates with a hook fastener strip 29 attached to the sweatband 7 for adjustable releasable locking engagement. Such hook and loop fasteners 21, 29, respectively, are typically constructed as loop and hook fabric tapes, generally known and identified by the public as "VELCRO" fasteners and operate in a manner well known to the public at large.

In the FIGS. 1–6 embodiment, the size adjustable strap 15 has an outer free end 25 that extends through a complementary shaped slot 27 provided in the crown 3 of the cap 1. The complementary shaped slot 27 is also provided in the vicinity of the sweatband 7, but on an opposite side of the cap opening 11, for receiving the outer free end 25 of the elongated strap 17. When received within the complementary shaped slot 27, the elongated strip 17 is positioned between the sweatband 7 and the cap crown 3. This is important in positioning the loop fasteners 21 of the strip 17 relative to the hook fasteners strip 29 that is sewn or otherwise attached to the inside of the sweatband 7.

Figure 3:
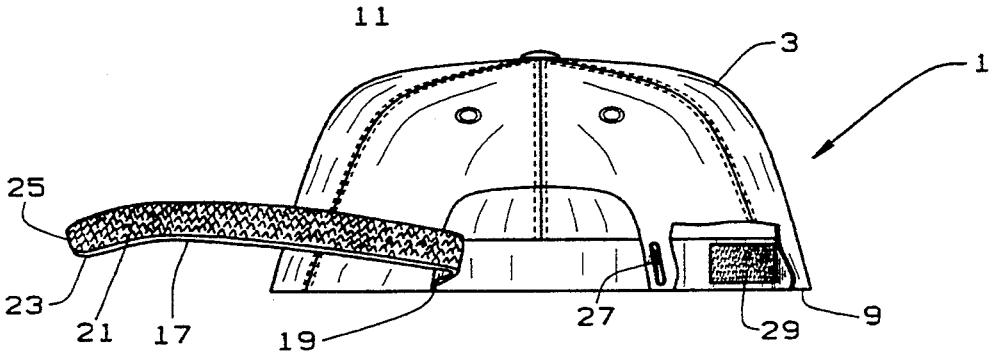

This is best shown in FIG. 3 of the drawings where a smaller strip of hook fasteners 29 is attached to the sweatband 7 between the sweatband 7 and the cap crown 3, enabling the hook fastener strip 29 to face outwardly relative to the sweatband 7.

Figure 4:
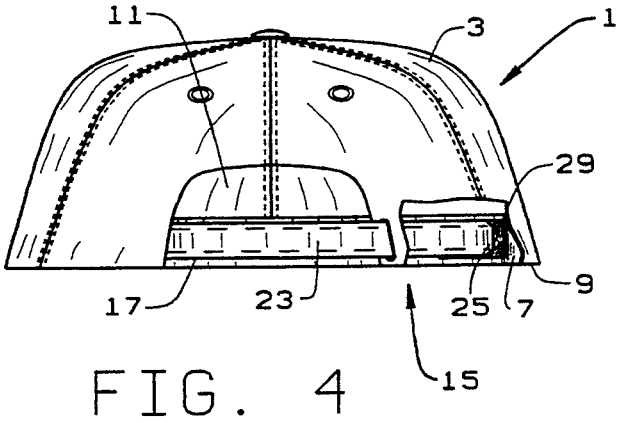
Figure 5:
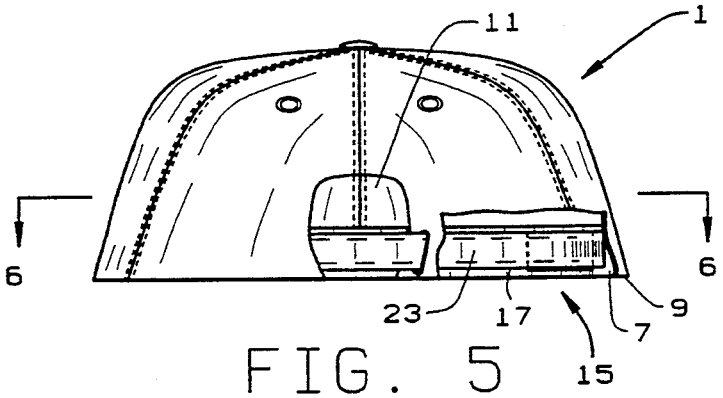

Reference to FIGS. 4–5 of the drawings will illustrate how the size adjustment strap 15 causes the rear opening 11 to change configuration, as the cooperating adjustable loop and hook fasteners 21, 29, respectively, are moved into different relative positions to each other. Thus, in FIG. 4 of the drawing, it will be seen that the outer free end 25 of the elongated strip 17 only partially covers the hook fasteners 29, indicating that the loop fasteners 21 engage part of the hook fastener strip 29, as indicated. This provides a shape for the cap opening 11 as illustrated, for example, in FIG. 4 of the drawings.

When the internal opening 13 of the cap is desired to be reduced in size, the outer free end 25 of the elongated strip 17 is moved beyond the hook fastener strip 29, thus closing or changing the shape of the opening 11, as illustrated in FIG. 5 of the drawings, and reducing the circumferential dimension of the cap opening 13.

Figure 6:
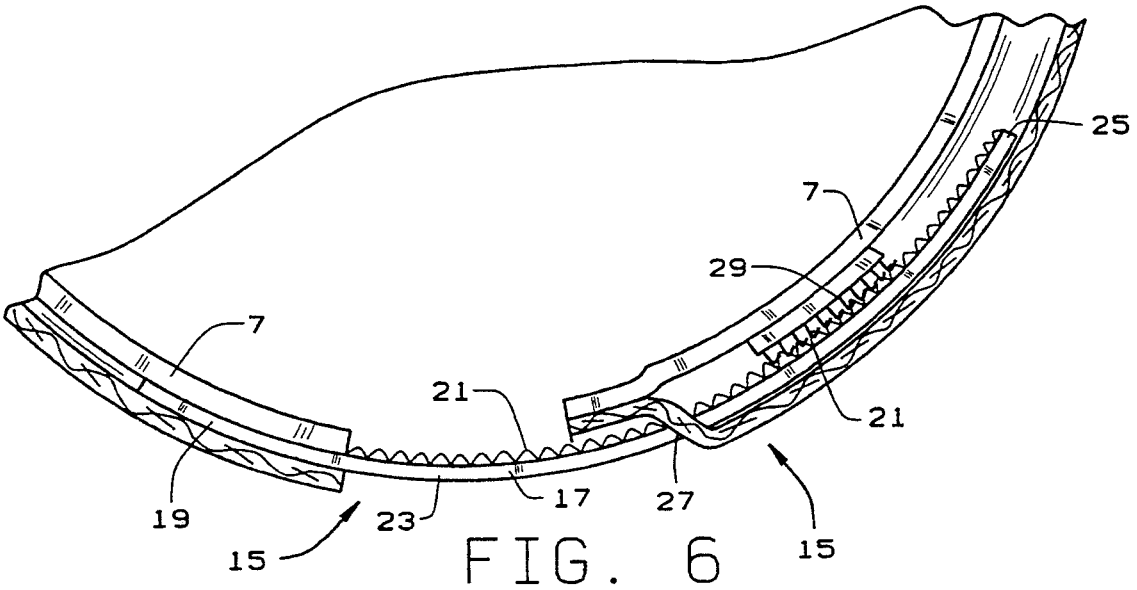

This particular arrangement is illustrated in the enlarged fragmentary top plan view, partially in section, shown in FIG. 6 of the drawings. There, it will be seen that the loop fasteners 21, attached to an inner face and extending inwardly relative to the elongated strip 17, engage the outwardly facing hook fasteners 29 that are attached to the sweatband 7 and positioned between the sweatband 7 and the cap crown 3.

Figure 2:
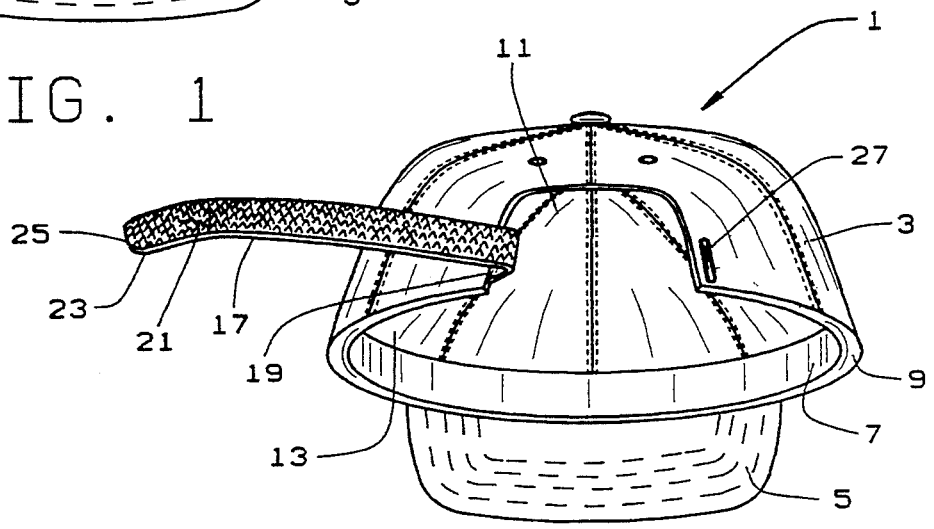

Note that the complementary shaped slot 27 formed in the crown 3 of the cap 1 is not only generally aligned with both the elongated strip 17 and the sweatband 7, but also extends at a slight angle to a plane that is transverse to the elongated strip 17 and the sweatband 7, as best shown in FIGS. 2–3 of the drawings. This facilitates the desired adjustability of the size adjustment strap 15, through a range of positions, as is shown, for example, in FIGS. 4–5 of the drawings.

Figure 7:
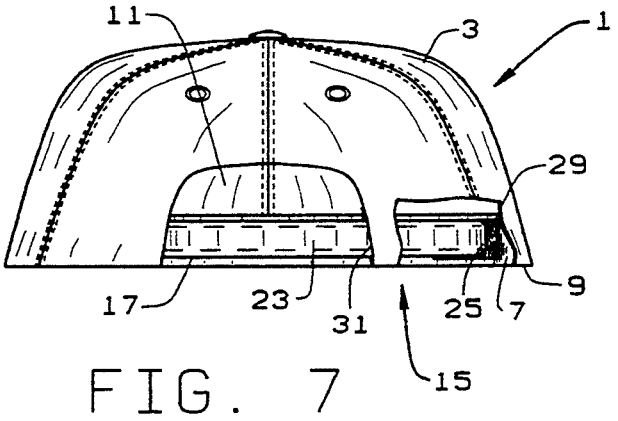
FIGS. 7–9 show a second embodiment of the size adjustment strap of the present invention.
Figure 8:
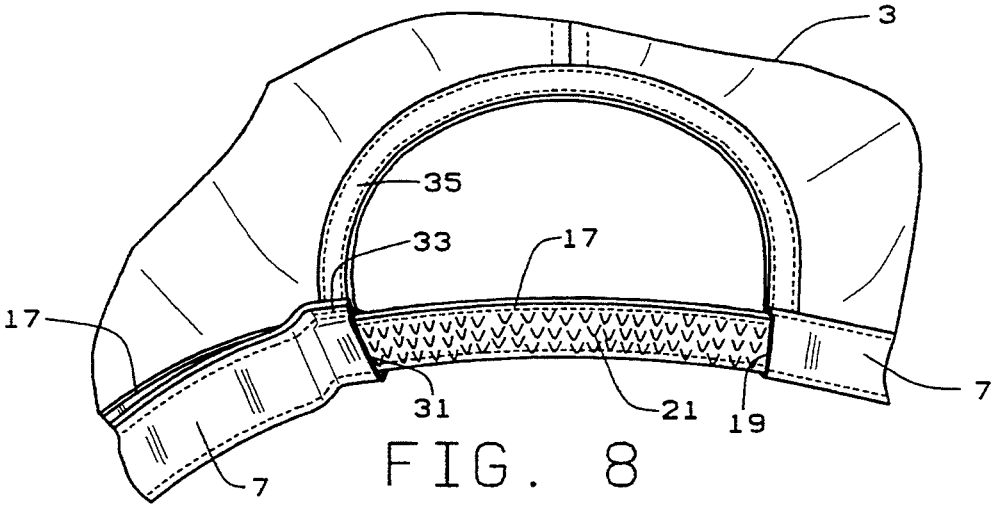
Figure 9:
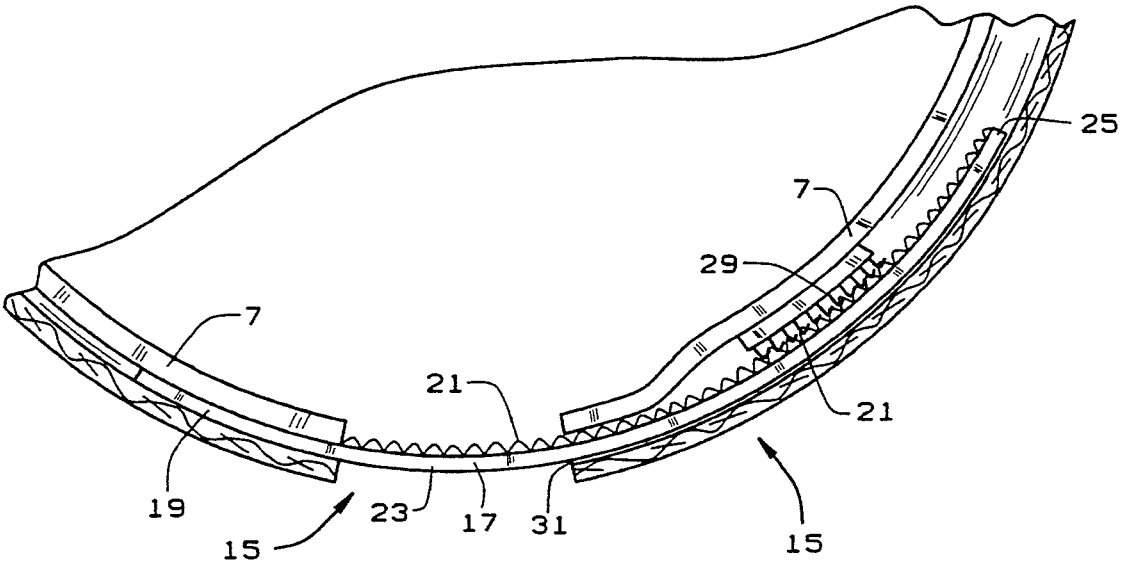

Reference is now made to FIGS. 7–9 of the drawings for a second embodiment of the present invention. The size adjustable cap 1 shown in FIGS. 7–9 of the drawings is essentially the same as the cap 1 shown in FIGS. 1–6 with the exception of the modified complementary shaped slot 31 that is formed in one end of the cap sweatband 7 for receiving the size adjustment strap 17. More particularly, as shown in the enlarged fragementary inside view of the cap illustrated in FIG. 8 of the drawings, it will be seen that the sweatband 7, on the opposite side of the cap opening 11 from the secured end 19 of the size adjustment strap 17, includes an upper marginal portion 33, in the vicinity of an outer marginal area of the sweatband 7, which is attached to the reinforcing strip 35 that extends around the cap opening 11. As a result, a laterally outwardly directed opening is provided in the form of the complementary shaped slot 31 for receiving the size adjustment strap 17, as illustrated in FIGS. 7–9 of the drawings. Thus, the size adjustment strap 17, when received within the complementary shaped opening 31, is capable of being adjustably positioned by the engagement and disengagement of the cooperating adjustable loop and hook fasteners 21, 29 respectively.

By having the complementary shaped slot 31 formed in an open end of the sweatband 7, as described above, a clean and attractive looking size adjustment strap is provided, particularly as viewed from the rear of the cap 1, as seen in FIG. 7 of the drawings. The complementary shaped slot 31 is positioned in general alignment with a size adjustable strap 17 for receiving the size adjustment strap 17, without overlying any portion of the cap 1. As compared to the size adjustment strap 17 shown in FIGS. 1–6 of the drawings, the size adjustment strap 17, in conjunction with the open ended complementary shaped slot 31 of the FIGS. 7–9 embodiment, provides an even more attractive and clean looking appearance than the FIGS. 1–6 embodiment.

With the above general construction of the first and second embodiments now understood, the simplicity, effectiveness and operation of the size adjustable strap 15 in the size adjustable cap 1 and its many advantages over other types of prior art size adjustment mechanisms or devices can now be described. In order to adjust the inner circumference of the cap opening 13, it is a relatively simple matter for a user to reach inside the cap, pull back the sweatband 7, and disengage the loop fastener from the hook fasteners 29. Then, by re-attaching the loop fastener 21 to the hook fasteners 29 at a different location, the user can increase or decrease the circumference of the cap opening 13. If the initial size selected is not desirable, the user can quickly repeat the above procedure and adjust the cap to the precise fit desired. As will be appreciated, this provides considerable adjustment capability for a user in adjusting the inner circumference of the cap opening 13 to the desired size. Unlike some other fastening mechanisms, not only is a precise adjustable fit obtainable, but the loop and hook releasable fastening engagement provides a strong and secure interengagement between the cooperating adjustable loop and hook fasteners, as is well known.

Preferably, the loop fastener strip 21 is used on the inside face of the elongated strip 17. Thus, the loop fastener strip 21 faces the head of a user when the elongated strip 17 extends through the complementary slot 27 in the cap. As will be appreciated, the loop fasteners on the inside face of the elongated strip 17 will not interfere or engage the hair of a user, when the cap is worn. Preferably, the loop fasteners 21 extend inwardly, while the hook fasteners 29 extend outwardly relative to the head of a user, as is best illustrated in FIG. 6 of the drawings.

The strip of fabric material 23 that is sewn or otherwise attached to the loop fastener strip 21 is constructed to cover the loop fastener 21, while also facing outwardly from the head of a user when the cooperating adjustable fastening means are in engagement with one another. This enables the cap manufacturer to use a fabric material for the fabric strip 23 that is the same fabric material as the cap crown 3 and the visor 5. As will be appreciated, this provides a much more attractive appearance with a coordinated design look than other prior art devices.

If desired, the cap manufacture can imprint or sew an advertising medium or logo in the fabric strip 23, in various colors and shapes, as may be desired. This provides a further reason for the use of the combined fabric material strip 23 and loop fastener strip 21 in the construction illustrated and described.

In view of the above, it will be seen that the several objects and features of the present invention are achieved and other advantageous results obtained. As various changes could be made in the above constructions without departing from the scope of the invention, it is intended that all matter contained in the above description or shown in the accompanying drawings shall be illustrative and not used in a limiting sense.

I claim:

1. A size adjustable cap having a crown with an opening in the back of the cap between the cap and a size adjustment strap extending across the opening, said size adjustment strap having one end secured in fixed position to the cap in alignment with of a sweatband that is internally attached to the cap proximate its lower margin, said size adjustment strap having a free end that extends through a complementary shaped slot provided in the crown of the cap in the vicinity of the sweatband on an opposite side of the cap opening from the fixed end of the size adjustment strap in order to allow the size adjustment strap to pass through the complementary shaped slot for positionment between the sweatband and the crown, cooperating adjustable loop and hook fastening means associated with said size adjustment strap and said sweatband for engagement with one another when said size adjustment strap is positioned between the sweatband and the crown, said loop fastening means being associated with said size adjustment strap and facing the head of a user when the size adjustment strap extends through the complementary shaped slot in said crown while said hook fastening means are associated with said sweatband, and said size adjustment strap further including a strip of fabric material covering said loop fasteners and facing outwardly from a user when the cooperating adjustable loop and hook fastening means are in engagement with one another.

2. The size adjustable cap as defined in claim 1 wherein the complementary shaped slot is provided in the cap at a position laterally offset inwardly from the opening in the back of the cap and being generally aligned with both said size adjustment strap and said sweatband.

3. A size adjustable cap having an opening in the back of the cap between the cap and a size adjustment strap extending across the opening, said size adjustment strap having one end secured in fixed position to the cap in the vicinity of a sweatband that is internally attached to the cap proximate its lower margin, said size adjustment strap having a free end that extends through a complementary shaped slot provided in the cap in the vicinity of the sweatband on an opposite side of the cap opening from the fixed end of the size adjustment strap in order to allow the size adjustment strap to pass through the complementary shaped slot for positionment between the sweatband and the cap, said complementary shaped slot being generally aligned with both said size adjustment strap and said sweatband, cooperating adjustable loop and hook fastener associated with said size adjustment strap and said sweatband for engagement with one another when said size adjustment strap is positioned between the sweatband and the cap, said loop fasteners being associated with said size adjustment strap and said hook fasteners being associated with said sweatband, said loop fasteners facing toward the head of a user when the size adjustment strap extends through the complementary shaped slot in said cap, said size adjustment strap further including a strip of fabric material covering said loop fasteners and facing outwardly away from the head of a user, said size adjustment strap further includes a strip of fabric material which covers the size adjustment strap fastening means and faces outwardly from the head of a user when the cooperating adjustable fastening means are in engagement with one another, and said complementary shaped slot provided in the cap at a position laterally outwardly offset from the opening in the back of the cap and being generally aligned with both said size adjustment strap and said sweatband.

4. A size adjustable cap having a crown with an opening in the back of the cap between the cap and a size adjustment strap extending across the opening, said size adjustment strap having one end secured in fixed position of the cap in the vicinity of a sweatband that is internally attached to the cap proximate its lower margin, said size adjustment strap having a free end that extends through a complementary shaped slot provided in the crown in the vicinity of the sweatband on an opposite side of the cap opening from the fixed end of the size adjustment strap in order to allow the size adjustment strap to pass through the complementary shaped slot for positionment between the sweatband and the crown, said complementary shaped slot being generally aligned with both said size adjustment strap and said sweatband, cooperating adjustable fastening means associated with said size adjustment strap and said sweatband for engagement with one another when said size adjustment strap is positioned between the sweatband and the crown, said loop fasteners being associated with said size adjustment strap and said hook fasteners being associated with said sweatband, said loop fasteners facing toward the head of a user when the size adjustment strap extends through the complementary shaped slot in said crown, said size adjustment strap further including a strip of fabric material covering said loop fasteners and facing outwardly away from the head of a user, said size adjustment strap further includes a strip of fabric material which covers the size adjustment strap fastening means and faces outwardly from the head of a user when the cooperating adjustable fastening means arc in engagement with one another, and the sweatband on the opposite side of the cap opening from said size adjustment strap includes an upper marginal portion in the vicinity of an outer marginal area of said sweatband which is attached to said cap to provide a complementary shaped slot defining a laterally outwardly directed opening which is generally aligned with said size adjustment strap.

* * * * *